US010783592B2

(12) United States Patent
Amano et al.

(10) Patent No.: US 10,783,592 B2
(45) Date of Patent: Sep. 22, 2020

(54) COLLECTING SOCIAL MEDIA USERS IN A SPECIFIC CUSTOMER SEGMENT

(71) Applicant: INTERNATIONAL BUSINESS MACHINES CORPORATION, Armonk, NY (US)

(72) Inventors: Shunichi Amano, Kanagawa (JP); Kohichi Kamijoh, Kanagawa-ken (JP); Masaki Ono, Tokyo (JP); Daisuke Takuma, Tokyo (JP)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 702 days.

(21) Appl. No.: 14/928,842

(22) Filed: Oct. 30, 2015

(65) Prior Publication Data

US 2017/0124160 A1 May 4, 2017

(51) Int. Cl.
*G06Q 50/00* (2012.01)

(52) U.S. Cl.
CPC ..... *G06Q 50/01* (2013.01)

(58) Field of Classification Search
CPC ..... G06Q 50/01
See application file for complete search history.

(56) References Cited

U.S. PATENT DOCUMENTS 7,970,111 B2 6/2011 Swanburg
9,076,349 B2 7/2015 Gupta
2002/0165861 A1* 11/2002 Gilmour ..... G06F 17/30616
2007/0198598 A1* 8/2007 Betz ..... G06F 17/30533
2010/0030578 A1* 2/2010 Siddique ..... G06Q 10/0637 705/3
2012/0054189 A1* 3/2012 Moonka ..... G06Q 30/02 707/740
2012/0110071 A1* 5/2012 Zhou ..... G06Q 10/10 709/204

(Continued)

OTHER PUBLICATIONS

Bosnjak, et al., "TwitterEcho—A Distributed Focused Crawler to Support Open Research with Twitter Data", WWW 2012 Companion, Apr. 2012, 7 pages.

(Continued)

*Primary Examiner* — Alford W Kindred
*Assistant Examiner* — Lin Lin M Htay
(74) *Attorney, Agent, or Firm* — Tutunjian & Bitetto, P.C.; Vazken Alexanian

(57) ABSTRACT

A method and system are provided for collecting social media users who have a specific profile. The method includes retrieving a set of lists connected by at least one criterion to a particular list that is included in a set of reliable lists whose users have already been reliably deemed to have a specific profile. The method includes calculating a list name based confidence value and a list member based confidence value for each list in the retrieved set of lists. The method includes updating the set of reliable lists by adding all lists in the retrieved set of lists that have the list name based confidence value above a first threshold value and the list member based confidence value above a second threshold value. The method includes outputting a listing of users belonging to set of reliable lists as the social media users who have the specific profile.

19 Claims, 7 Drawing Sheets

(56) References Cited

U.S. PATENT DOCUMENTS

| | | | | |
|---|---|---|---|---|
| 2012/0209839 | A1* | 8/2012 | Andrews | G06Q 10/10 707/728 |
| 2012/0331055 | A1 | 12/2012 | Cross et al. | |
| 2013/0226910 | A1* | 8/2013 | Work | G06Q 10/00 707/722 |
| 2014/0013240 | A1* | 1/2014 | Ganesh | G06Q 30/02 715/753 |
| 2014/0101243 | A1 | 4/2014 | Naveh et al. | |
| 2014/0195549 | A1* | 7/2014 | Ahn | H04L 51/32 707/749 |

OTHER PUBLICATIONS

Bozak, et al., "KAON—Towards a Large Scale Semantic Web", E-Commerce and Web Technologies, Springer, Aug. 2002, 10 pages.
Burger, et al., "Discriminating Gender on Twitter", Proceedings of the 2011 Conference on Empirical Methods in Natural Language Processing, Jul. 2011, pp. 1301-1309.
Byun, et al., "Automated Twitter Data Collecting Tool for Data Mining in Social Network", RACS'12, Oct. 2012, pp. 76-79.
Chakrabarti, et al., "Focused crawling: A New Approach to Topic-specific Web Resource Discovery", May 1999, vol. 31, Issues 11-16, pp. 1623-1640.
Cheng, et al., "You Are Where You Tweet: A Content-Based Approach to Geo-locating Twitter Users", CIKM'10, Oct. 2010, 10 pages.
Ehrig, et al., "Ontology Focused Crawling of Web Documents", SAC 2003, March 5 Pages.
Fortunato, Community Detection in Graphs, Physicis.soc-ph, Jan. 2010, pp. 1-103.
Jaffali, et al., "Clustering and Classification of Like-Minded People from Their Tweets", 2014 IEEE International Conference on Data Mining Workshop, Dec. 2014, 7 pages.
Li et al.,"Towards Social Data Platform: Automatic Topic focused Monitor for Twitter Stream", Proceedings of the VLDB Endowment, Aug. 2013, vol. 6, No., 14 pages.
Lim et al., "The Identification of Like-minded Communities on Online Social Networks",Thesis for: Master of Science (Research), 2013, 108 pages.
Mahmud, et al., "Home Location Identification of Twitter Users", ACM Trans. Intell. Syst. Technol. 5, 3, Article 47 Jul. 2014, 21 pages.
Nasirifard, et al., "Tadvise: A Twitter Assistant Based on Twitter Lists", SocInfo'11 Proceedings of the Third international conference on Social informatics, Oct. 2011, 8 pages.
Nishida et al., "Twiiter Bolg: Estimation of Twitter User Attributes by Learning from Users Who Have Both Twitter and Blog Acounts and Utilization User Homophily", DBSJ Journal, Jun. 2013, , vol. 12, No. 1., 6 pages.
Pennacchiotti, et al., "Democrats, Republicans and Starbucks Afficionados:User Classification in Twitter", KDD'11, Aug. 2011, pp. 430-438.
Silva, et al., "Characterising the Emergent Semantics in Twitter Lists", Ontology Engineering Group, The Semantic Web, 22 pages.
Yamaguchi, et al., "Tag-based User Topic Discovery Using Twitter Lists", 2011 International Conference on Advances in Social Networks Analysis and Mining, Jul. 2011, pp. 1-20.

* cited by examiner

COLLECTING SOCIAL MEDIA USERS IN A SPECIFIC CUSTOMER SEGMENT

BACKGROUND

Technical Field

The present invention relates generally to social media and, in particular, to collecting social media users in a specific customer segment.

Description of the Related Art

Profiling techniques for social media users is important for at least the following two reasons. First, profiling techniques are essential to deliver a personalized service which is one of the efficient methodologies to improve user satisfaction and service conversion. One example is recommendation of users, tweets and advertisements in which a user seems to be interested. Second, current social media is too huge and diverse to manually analyze.

Accordingly, seeking users who have a specific user profile takes much time because too many users exist on social media. Hence, there is a need a way to harvest social media users in a specific customer segment.

SUMMARY

According to an aspect of the present principles, a method is provided for collecting social media users who have a specific profile. The method includes retrieving over one or more networks, by a hardware network interface, a set of lists connected by at least one criterion to a particular list. The particular list is included in a set of reliable lists whose users have already been reliably deemed to have a specific profile. The method further includes calculating, by a processor-based confidence value calculator, a list name based confidence value and a list member based confidence value for each list in the retrieved set of lists. The method also includes updating, by a list manager, the set of reliable lists by adding all of the lists in the retrieved set of lists that have the list name based confidence value above a first threshold value and the list member based confidence value above a second threshold value. The method additionally includes outputting, by at least one of a display device and the hardware interface, a listing of users belonging to set of reliable lists as the social media users who have the specific profile.

According to another aspect of the present principles, a computer program product is provided for collecting social media users who have a specific profile. The computer program product includes a non-transitory computer readable storage medium having program instructions embodied therewith. The program instructions are executable by a computer to cause the computer to perform a method. The method includes retrieving over one or more networks, by a hardware network interface, a set of lists connected by at least one criterion to a particular list. The particular list is included in a set of reliable lists whose users have already been reliably deemed to have a specific profile. The method further includes calculating, by a processor-based confidence value calculator, a list name based confidence value and a list member based confidence value for each list in the retrieved set of lists. The method also includes updating, by a list manager, the set of reliable lists by adding all of the lists in the retrieved set of lists that have the list name based confidence value above a first threshold value and the list member based confidence value above a second threshold value. The method additionally includes outputting, by at least one of a display device and the hardware interface, a listing of users belonging to set of reliable lists as the social media users who have the specific profile.

According to yet another aspect of the present principles, a system is provided for collecting social media users who have a specific profile. The system includes a hardware network interface for retrieving over one or more networks a set of lists connected by at least one criterion to a particular list. The particular list is included in a set of reliable lists whose users have already been reliably deemed to have a specific profile. The system further includes a processor-based confidence value calculator for calculating a list name based confidence value and a list member based confidence value for each list in the retrieved set of lists. The system also includes a list manager for updating the set of reliable lists by adding all of the lists in the retrieved set of lists that have the list name based confidence value above a first threshold value and the list member based confidence value above a second threshold value. At least one of a display device and the hardware interface outputs a listing of users belonging to set of reliable lists as the social media users who have the specific profile.

These and other features and advantages will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein.

DETAILED DESCRIPTION OF PREFERRED EMBODIMENTS

The present principles are directed to collecting social media users in a specific customer segment.

Figure 1:
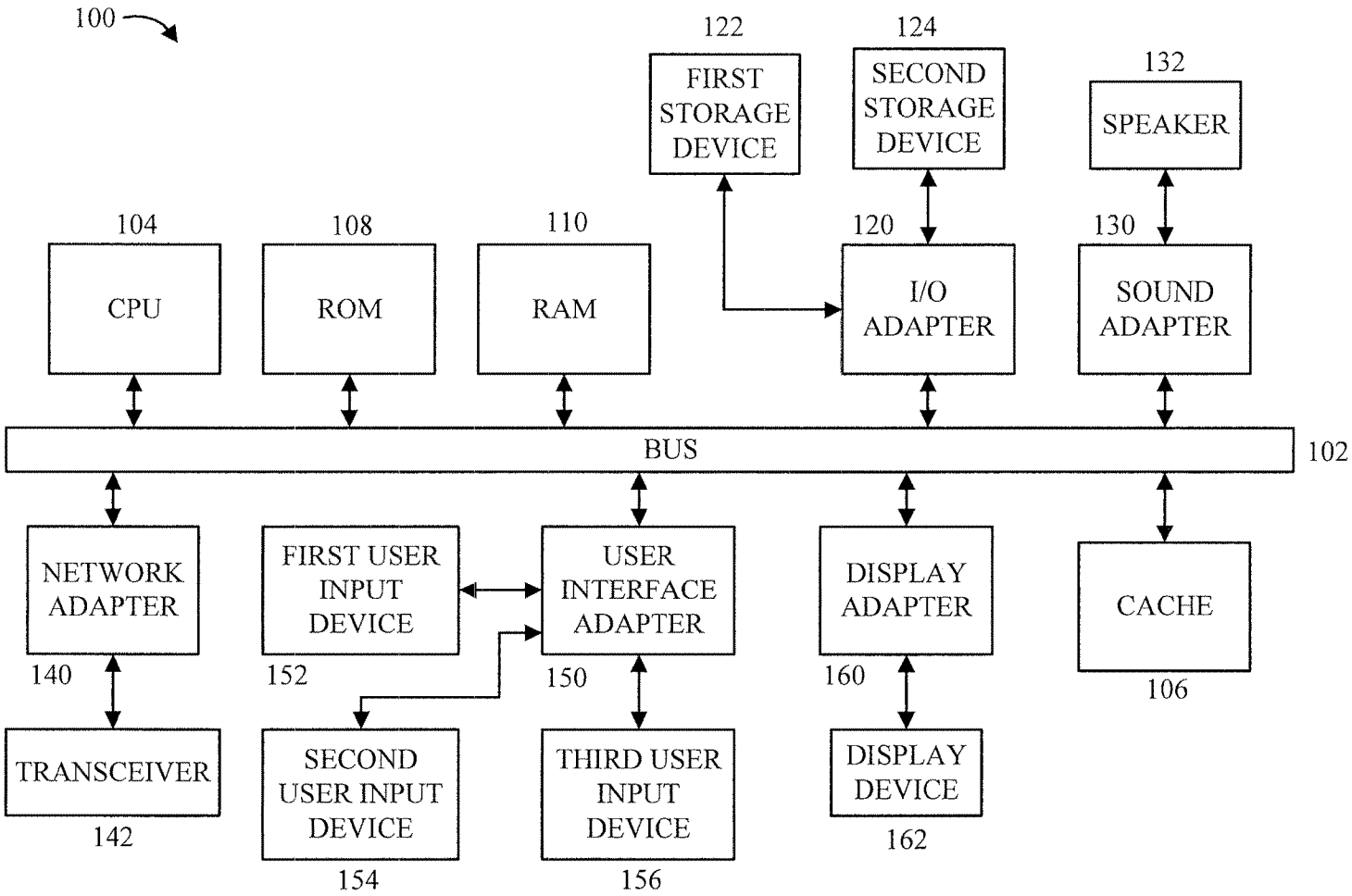
FIG. 1 shows an exemplary processing system 100 to which the present principles may be applied, in accordance with an embodiment of the present principles.

FIG. 1 shows an exemplary processing system 100 to which the present principles may be applied, in accordance with an embodiment of the present principles. The processing system 100 includes at least one processor (CPU) 104 operatively coupled to other components via a system bus 102. A cache 106, a Read Only Memory (ROM) 108, a Random Access Memory (RAM) 110, an input/output (I/O) adapter 120, a sound adapter 130, a network adapter 140, a user interface adapter 150, and a display adapter 160, are operatively coupled to the system bus 102.

A first storage device 122 and a second storage device 124 are operatively coupled to system bus 102 by the I/O adapter 120. The storage devices 122 and 124 can be any of a disk storage device (e.g., a magnetic or optical disk storage device), a solid state magnetic device, and so forth. The storage devices 122 and 124 can be the same type of storage device or different types of storage devices.

A speaker 132 is operatively coupled to system bus 102 by the sound adapter 130. A transceiver 142 is operatively coupled to system bus 102 by network adapter 140. A display device 162 is operatively coupled to system bus 102 by display adapter 160.

A first user input device 152, a second user input device 154, and a third user input device 156 are operatively coupled to system bus 102 by user interface adapter 150. The user input devices 152, 154, and 156 can be any of a keyboard, a mouse, a keypad, an image capture device, a motion sensing device, a microphone, a device incorporating the functionality of at least two of the preceding devices, and so forth. Of course, other types of input devices can also be used, while maintaining the spirit of the present principles. The user input devices 152, 154, and 156 can be the same type of user input device or different types of user input devices. The user input devices 152, 154, and 156 are used to input and output information to and from system 100.

Of course, the processing system 100 may also include other elements (not shown), as readily contemplated by one of skill in the art, as well as omit certain elements. For example, various other input devices and/or output devices can be included in processing system 100, depending upon the particular implementation of the same, as readily understood by one of ordinary skill in the art. For example, various types of wireless and/or wired input and/or output devices can be used. Moreover, additional processors, controllers, memories, and so forth, in various configurations can also be utilized as readily appreciated by one of ordinary skill in the art. These and other variations of the processing system 100 are readily contemplated by one of ordinary skill in the art given the teachings of the present principles provided herein.

Figure 2:
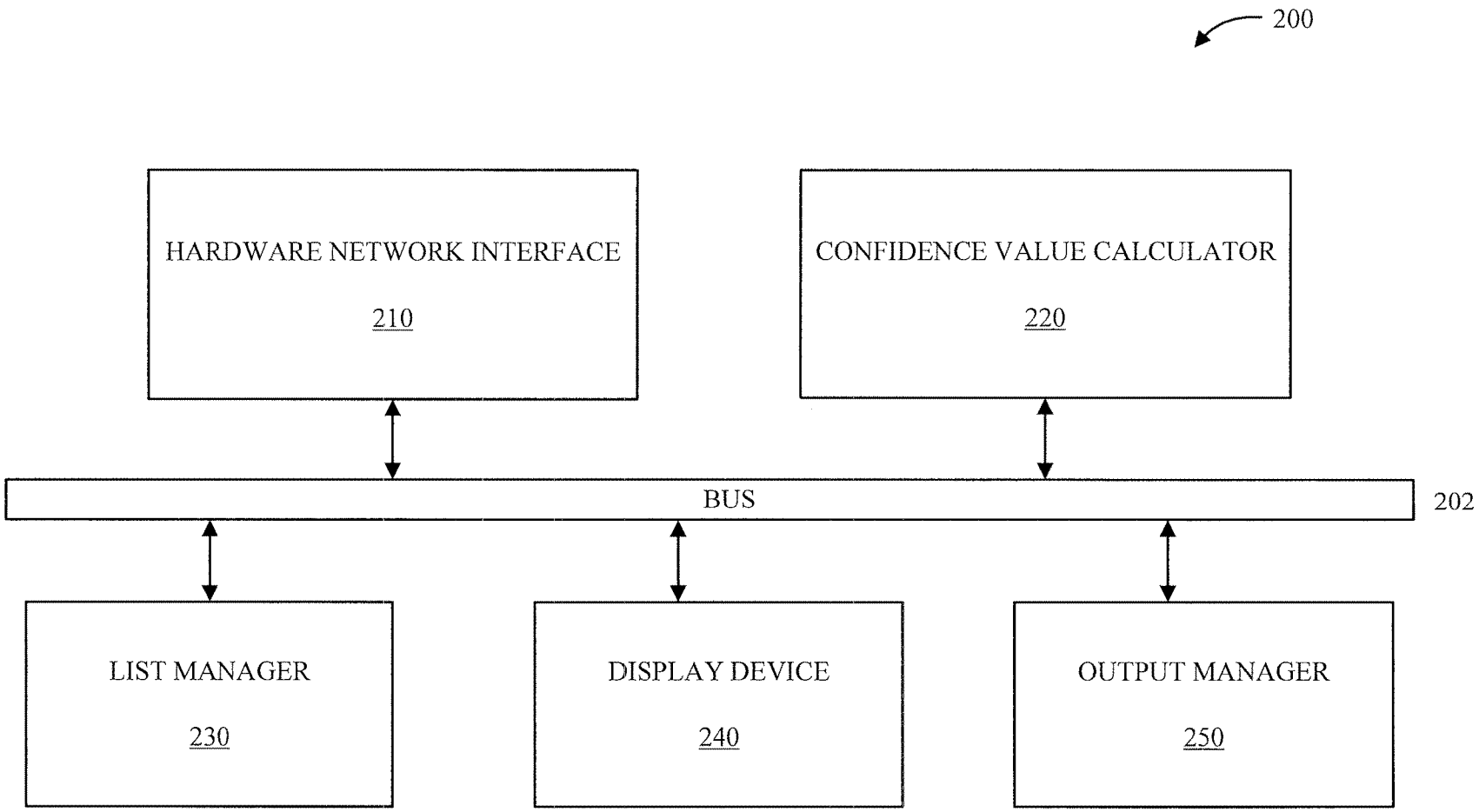
FIG. 2 shows an exemplary system 200 for collecting social media users in a specific customer segment, in accordance with an embodiment of the present principles.

Moreover, it is to be appreciated that system 200 described below with respect to FIG. 2 is a system for implementing respective embodiments of the present principles. Part or all of processing system 100 may be implemented in one or more of the elements of system 200.

Figure 3:
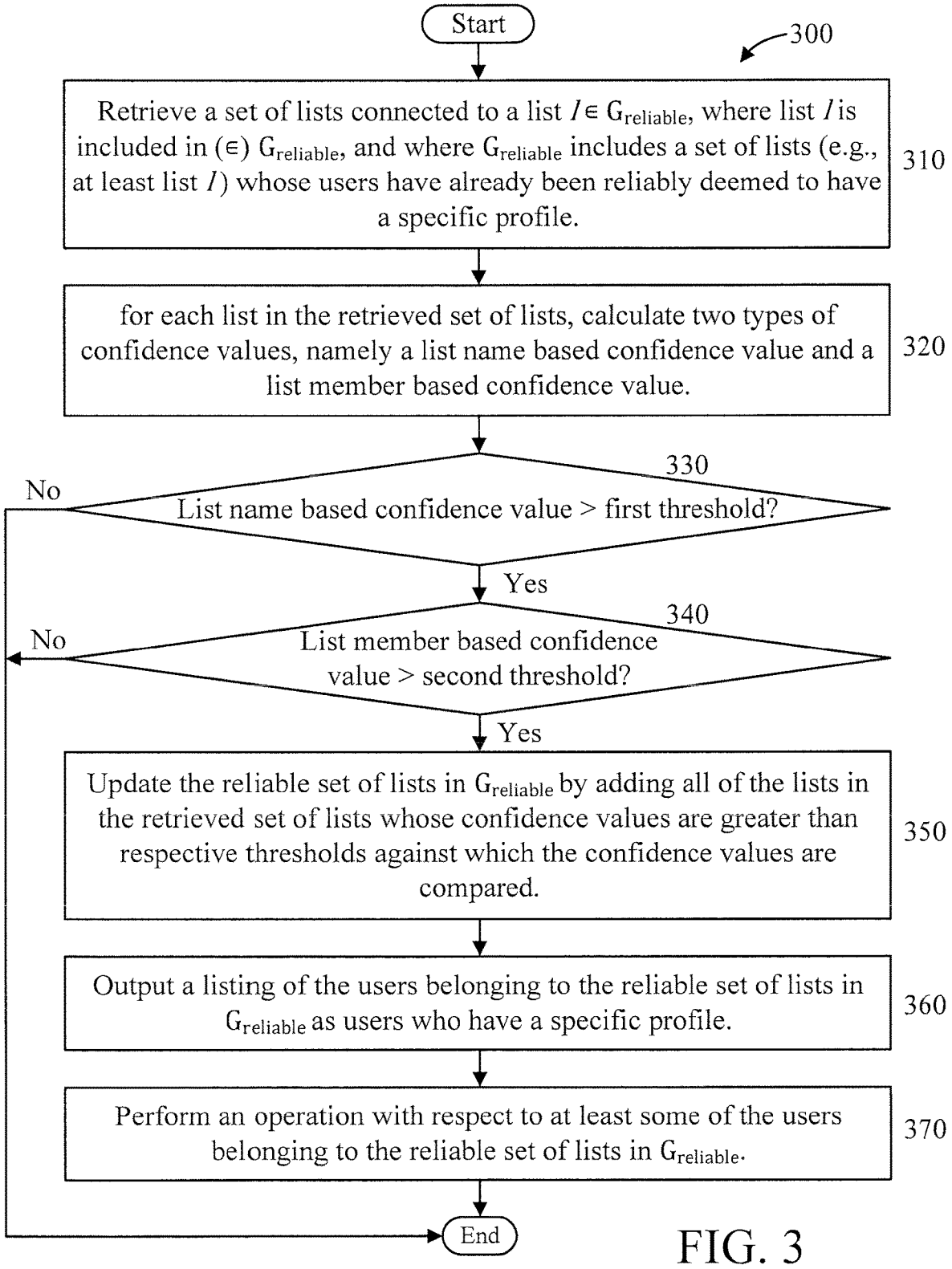
FIG. 3 shows an exemplary method 300 for collecting social media users in a specific customer segment, in accordance with an embodiment of the present principles.

Further, it is to be appreciated that processing system 100 may perform at least part of the method described herein including, for example, at least part of method 300 of FIG. 3. Similarly, part or all of system 200 may be used to perform at least part of method 300 of FIG. 3.

FIG. 2 shows an exemplary system 200 for collecting social media users who have a specific profile, in accordance with an embodiment of the present principles.

The system 200 includes a hardware network interface 210, a confidence value calculator 220, a list manager 230, a display device 240, and an output manager 250.

The hardware network interface 210 interfaces system 200 with one or more networks (e.g., the Internet) to retrieve, over the one or more networks, a set of lists connected by at least one criterion to a particular list. The particular list is included in a set of reliable lists (e.g., $G_{reliable}$, as described in further detail herein below) whose users have already been reliably deemed to have a specific profile. The hardware network interface 210 can include a wire-based hardware network interface 210A and a wireless-based hardware network interface 210B.

The confidence value calculator 220 calculates confidence values for determining which groups have a specific profile (e.g., specific customer segment). The confidence value calculator 220 includes a list name based confidence value calculator 220A for calculating a list name based confidence value for each list in the retrieved set of lists. The confidence value calculator 220 also includes a list member based confidence value calculator 220B for calculating a list member based confidence value for each list in the retrieved set of lists.

The list manager 230 updates the set of reliable lists by adding all of the lists in the retrieved set of lists that have the list name based confidence value above a first threshold value and the list member based confidence value above a second threshold value. The list manager 230 includes a confidence value evaluator 230A for comparing, for each list in the retrieved set of lists, the list name based confidence value to the first threshold value. The confidence value evaluator 230A also compares, for each list in the retrieved set of lists, the list member based confidence value to the second threshold value.

The display device 240 and/or the hardware network interface 210 output a listing of users belonging to set of reliable lists as the social media users who have the specific profile.

The output manager 250 control the outputting of the listing of users belonging to set of reliable lists as the social media users who have the specific profile. The output manager 250 can direct the listing to either or both of the display device 240 and the hardware network interface 210. The output manager 250 can also perform sorting or other operations on the listing for the purposes of outputting the listing in a certain order as further described herein.

In the embodiment shown in FIG. 2, the elements thereof are interconnected by a bus(es)/network(s) 201. However, in other embodiments, other types of connections can also be used. Moreover, in an embodiment, at least one of the elements of system 200 is processor-based. Further, while one or more elements (e.g., the confidence value calculator 220 and the list manager 230) may be shown as separate elements, in other embodiments, these elements can be combined as one element. The converse is also applicable, where while one or more elements (e.g., the list name based confidence value calculator 220A and the list member based confidence value calculator 220B) may be part of another element, in other embodiments, the one or more elements may be implemented as standalone elements. These and other variations of the elements of system 200 are readily determined by one of ordinary skill in the art, given the teachings of the present principles provided herein, while maintaining the spirit of the present principles.

FIG. 3 shows an exemplary method 300 for collecting social media users in a specific customer segment, in accordance with an embodiment of the present principles.

At step 310, retrieve a set of lists connected to a list $L \in G_{reliable}$, where list L is included in ($\in$) $G_{reliable}$, and where $G_{reliable}$ includes a set of lists (e.g., at least list L) whose users have already been reliably deemed to have a specific profile. In an embodiment, $G_{reliable}$ includes at least list L as a starting point.

As noted above, the lists in the retrieved set of lists are connected to list L. The "connection" can be based on group label (same or similar label), group member composition (same or similar composition), a textual similarity between group member's posts, and so forth. Regarding group member composition, the same can be determined from the member list without having to review each user's profile. The connection can even be based on being on the same social media (e.g., Twitter®, Facebook®, etc.), although using this criterion alone (being on the same social media) will increase processing time, versus pruning the processed groups using the aforementioned, more specific criteria. The preceding criteria and merely illustrative and, thus, other criteria can also be used for the basis of connection while maintaining the spirit of the present principles.

The first list in $G_{reliable}$, presumably list L, is determined (for inclusion in $G_{reliable}$) based on, for example, a user pre-selection, textual similarity to a subject, and so forth. Of course, other criteria can also be used while maintaining the spirit of the present principles.

At step 320, for each list in the retrieved set of lists, calculate two types of confidence values, namely a list name based confidence value and a list member based confidence value. In an embodiment, the function $c_{name}$ described below is used for the list name based confidence value, and the function $c_{user}$ described below is used for the list member based confidence value. Of course, given the teachings of the present principles provided herein, various modifications to these functions, as well as similar functions, can be readily implemented by one of ordinary skill in the art, while maintaining the spirit of the present principles.

At step 330, for each list in the retrieved set of lists, determine whether or not the list name based confidence value calculated there for is above a list name based threshold value. If so, then the method proceeds to step 340. Otherwise, the method is terminated. In an embodiment, the list name based threshold value is determined based on experiment, historical data, and so forth. Of course, other basis for the list name based threshold can also be used, while maintaining the spirit of the present principles.

At step 340, for each list in the retrieved set of lists, determine whether or not the list member based confidence value calculated there for is greater than a list member based confidence value. If so, then the method proceeds to step 350. Otherwise, the method is terminated. In an embodiment, the list member based confidence value is determined based on any known distance metric for two sets including, but not limited to, a dice coefficient, a Hamming distance, a Euclidean distance, and so forth. Of course, other basis for the list member based threshold can also be used, while maintaining the spirit of the present principles.

At step 350, update the reliable set of lists in $G_{reliable}$ by adding all of the lists in the retrieved set of lists whose confidence values (both the list name based confidence value and the list member based confidence value) are greater than respective thresholds against which the confidence values are compared.

At step 360, output a listing of the users belonging to the reliable set of lists in $G_{reliable}$ as users who have a specific profile. In an embodiment, step 360 can involve displaying the users belonging to the reliable set of lists in $G_{reliable}$. In an embodiment, the users can be output in an order (i.e., sorted) based on one or more criterion. For example, in an embodiment, users from groups with the highest margin over both thresholds can be listed descending order (or ascending order). In another embodiments, users from groups with the highest margin over a particular one of the two thresholds can be listed in a particular (e.g., descending or ascending). These and other orderings can be applied to the outputted users, while maintaining the spirit of the present principles. In an embodiment, the specific profile corresponds to a specific customer segment.

At step 370, perform an operation with respect to at least some of the users belonging to the reliable set of lists in $G_{reliable}$. The operation can be, but is not limited to, marketing, demographics, and so forth. The operation can be, but is not limited to, sending a targeted message, sending a targeted advertisement, sending a target invitation to another group or social media forum or website, forwarding a list of the users belonging to the reliable set of lists in $G_{reliable}$ to one or more remote devices (e.g., servers, cell phones, etc.), and so forth. The preceding examples of operations are merely illustrative and, thus, other operations can also be performed, while maintaining the spirit of the present principles.

It is to be appreciated that method 300 can be repeatedly performed based on some criteria. For example, the criteria can include, but is not limited to, as needed, according to one or more predetermined frequencies, randomly, and so forth.

Figure 4:
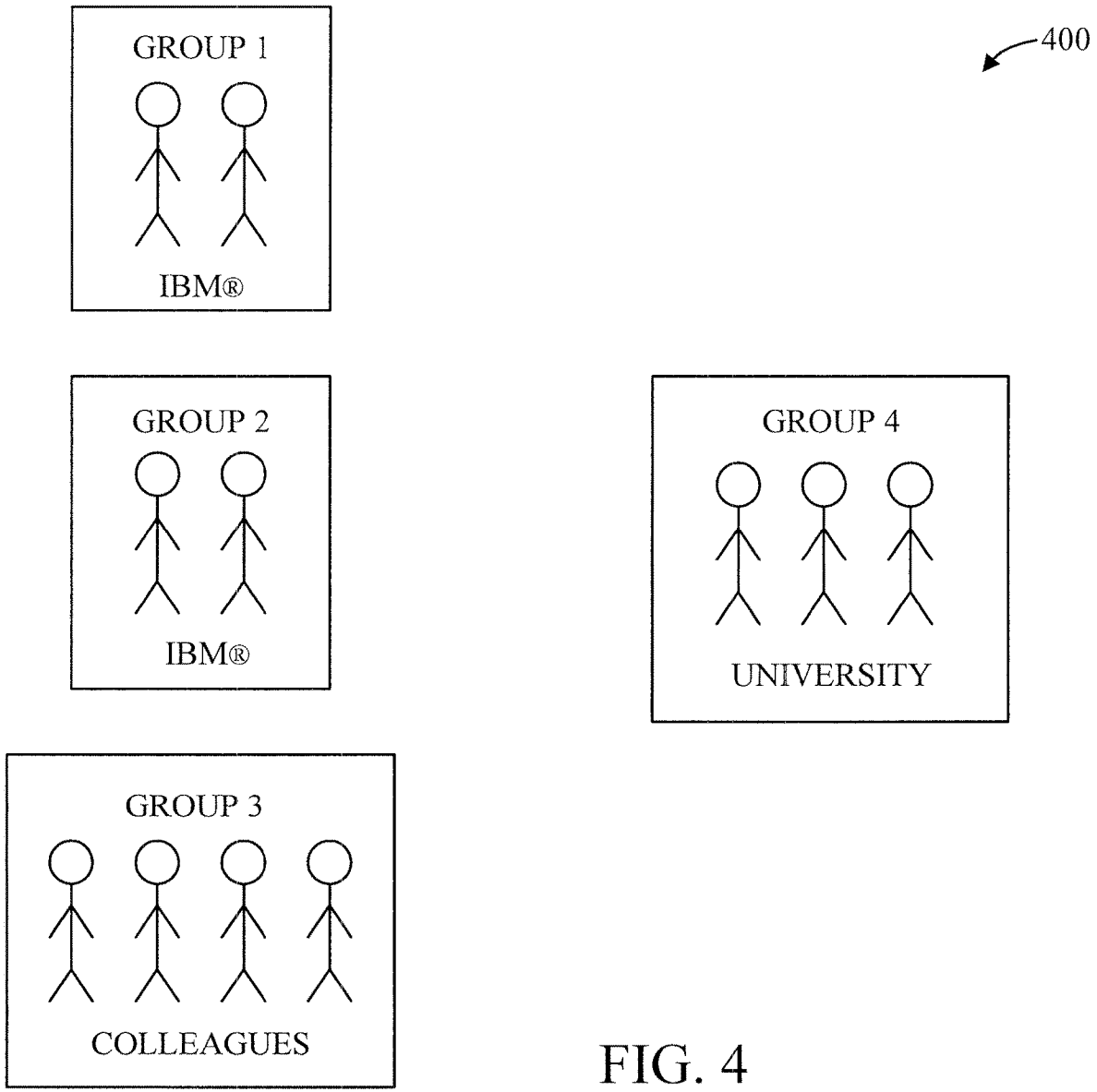
FIG. 4 shows exemplary social media groups 400 to which the present principles can be applied, in accordance with an embodiment of the present principles.

FIG. 4 shows exemplary social media groups 400 to which the present principles can be applied, in accordance with an embodiment of the present principles.

The exemplary social media groups 400 include four groups, namely a first group labeled "IBM"®, a second group also labeled "IBM"®, a third group labelled "colleagues", and a fourth group labeled "university".

In this example, we start with group 2. Hence, group 2 can be considered to be list L from reliable list $G_{reliable}$. We then look at group 1, whose label is the same as group 2 (namely "IBM"). Thus, group 2 will be evaluated by method 300.

We then look at group 3, whose member composition is similar to group 2. Thus, group 2 will be evaluated by method 300.

We then look at group 4, whose label and group membership differ from group 2. Thus, group 4 will not be evaluated by method 300.

A description will now be given regarding a list name based confidence value, in accordance with an embodiment of the present principles.

A function is defined which returns a confidence value for a list based on the list name. A list name (i.e., label) consists of one or more words, and can include hyphenated words. In the case of hyphenated words, each word can be considered separately. For example, "it-developers" consists of two words, namely "it" and "developers", and each of these words can be considered (processed) in accordance with the present principles.

Let $W_1$ be a set of words of a list g. Thus, in this case, list g would correspond to one of the retrieved lists from step 310. Let $G_w$ be a set of lists whose name includes word w. Let d be a minimum path length from a list to another list which as $w \in W_1$. In an embodiment, d is determined using Dijkstra's algorithm, which can find the shortest path between nodes in a graph. Of course, other approaches can also be used, while maintaining the spirit of the present principles. Let $\theta \in [0,1]$ be a constant number.

Let $c_{name}$ be a function which receives a list and returns a confidence value based on the list name.

$$c_{name}(g) = \frac{1}{|W_g|} \sum_{w \in W} g^f \, \mathrm{word}(w),$$

where $F_{word}(w) = \log(|G_w|+1) \times \theta^d$, and wherein $G_w$ denotes a set of groups whose name includes word w, $w_g$ denotes a set of words of a group g.

The parameter θ decays $f_{word}(w)$ and it is important not to capture common words in the Twitter (or other social media)

list. The meanings of common words depend on their context. For example, a list with a name "colleagues" means "colleagues from IBM" in a specific context, but in another context it has a different meaning. The context in this case means the shortest path length of nodes with the same name. For example, the shortest path length between groups names "colleagues in IBM"® is shorter than that of groups named "colleagues in Microsoft"®.

A description will now be given regarding a list member based confidence value, in accordance with an embodiment of the present principles.

A confidence value of a list is also calculated based on users belonging to the list. We calculate a dice coefficient between a given list g and another list $g' \in G_{reliable}$ and use a maximum value as the confidence value of the list g. Thus, in this case, list g would correspond to one of the retrieved lists from step 310.

Let $f_{user}$ be a function which maps a list g to a set of users who belong to g.

Let $c_{user}$ be a function which receives a list and returns a confidence value based on list name, as follows:

$$c_{user}(g) = \underset{g' \in G_{reliable}}{\operatorname{argmax}} \frac{|fu_{ser}(g) + fu_{ser}g'|}{|fu_{ser}(g)| + |fu_{ser}g'|}$$

A description will now be given regarding various considerations and factors (hereinafter "factors") on which one or more embodiment of the present principles are premised.

One factor is to presume that a list name expresses and/or otherwise represents a profile of its members. For example, a list name of "IBM"® will express and/or otherwise represent users that somehow relate to IBM® (e.g., IBM® employees, IBM® clients, etc.).

Another factor is that list names are collected which have the same meaning as a list to which a set of users belong. For example, when collecting list names for correspondence to the list "IBM"®, a list name of "colleagues" can have the same meaning as IBM® in a specific context and will thus be collected. It is to be appreciated that prior art approaches cannot understand "IBM"® and "colleagues" have the same meaning in a specific context, in contrast to the advantageous capabilities of the present principles.

Yet another factor is that the functions which return a confidence value use (1) inputted group information as well as (2) context information. For example, the function for a confidence value that is based on a list member utilizes information about $G_{reliable}$. Thus, in this way, we can avoid collecting other organization's "colleagues" (e.g., other than IBM®, with respect to the preceding example).

Definitions of some of the terms used here will now be provided, in accordance with an embodiment of the present principles.

The term "user" refers to a social media user.

The term "group" refers to two elements, namely (1) a user of users and (2) a label.

The term "label" refers to a short description formed from one or more words. In an embodiment, more than one list can have the same label. It is to be appreciated that the terms "label" and "list name" are used interchangeably herein.

Let $G_{ALL}$ be all groups in social media.

Let $G_{reliable} \subset G_{ALL}$ be a given set of lists whose members have a specific profile at a high probability.

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based email). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load balancing between clouds).

A cloud computing environment is service oriented with a focus on statelessness, low coupling, modularity, and semantic interoperability. At the heart of cloud computing is an infrastructure comprising a network of interconnected nodes.

Figure 5:
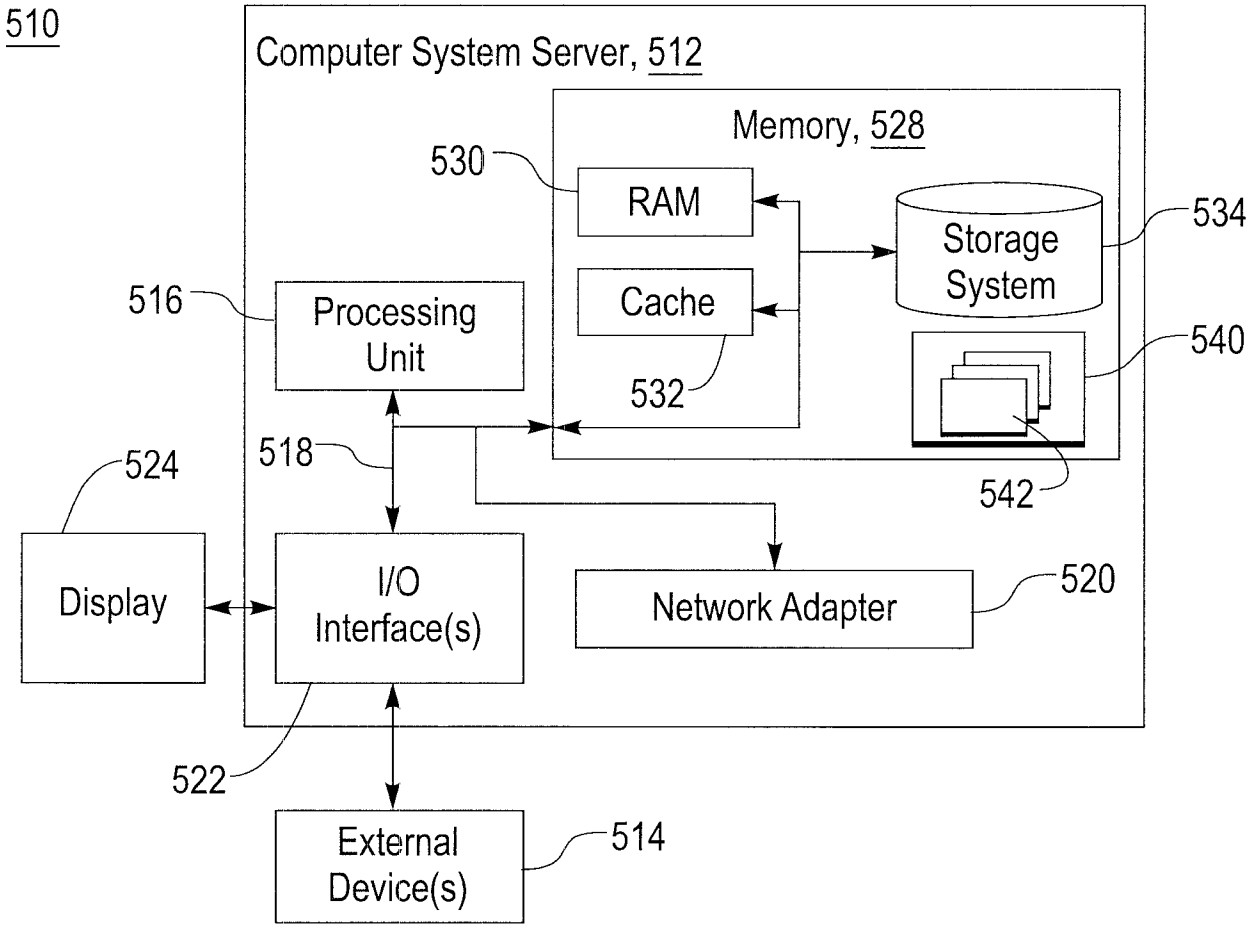
FIG. 5 shows an exemplary cloud computing node 510, in accordance with an embodiment of the present principles.

Referring now to FIG. 5, a schematic of an example of a cloud computing node 510 is shown. Cloud computing node 510 is only one example of a suitable cloud computing node and is not intended to suggest any limitation as to the scope of use or functionality of embodiments of the invention described herein. Regardless, cloud computing node 510 is capable of being implemented and/or performing any of the functionality set forth hereinabove.

In cloud computing node 510 there is a computer system/server 512, which is operational with numerous other general purpose or special purpose computing system environments or configurations. Examples of well-known computing systems, environments, and/or configurations that may be suitable for use with computer system/server 512 include, but are not limited to, personal computer systems, server computer systems, thin clients, thick clients, handheld or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 512 may be described in the general context of computer system executable instructions, such as program modules, being executed by a computer system. Generally, program modules may include routines, programs, objects, components, logic, data structures, and so on that perform particular tasks or implement particular abstract data types. Computer system/server 512 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 5, computer system/server 512 in cloud computing node 510 is shown in the form of a general-purpose computing device. The components of computer system/server 512 may include, but are not limited to, one or more processors or processing units 516, a system memory 528, and a bus 518 that couples various system components including system memory 528 to processor 516.

Bus 518 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computer system/server 512 typically includes a variety of computer system readable media. Such media may be any available media that is accessible by computer system/server 512, and it includes both volatile and non-volatile media, removable and non-removable media.

System memory 528 can include computer system readable media in the form of volatile memory, such as random access memory (RAM) 530 and/or cache memory 532. Computer system/server 512 may further include other removable/non-removable, volatile/non-volatile computer system storage media. By way of example only, storage system 534 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 518 by one or more data media interfaces. As will be further depicted and described below, memory 528 may include at least one program product having a set (e.g., at least one) of program modules that are configured to carry out the functions of embodiments of the invention.

Program/utility 540, having a set (at least one) of program modules 542, may be stored in memory 528 by way of example, and not limitation, as well as an operating system, one or more application programs, other program modules, and program data. Each of the operating system, one or more application programs, other program modules, and program data or some combination thereof, may include an implementation of a networking environment. Program modules 542 generally carry out the functions and/or methodologies of embodiments of the invention as described herein.

Computer system/server 512 may also communicate with one or more external devices 514 such as a keyboard, a pointing device, a display 524, etc.; one or more devices that enable a user to interact with computer system/server 512; and/or any devices (e.g., network card, modem, etc.) that enable computer system/server 512 to communicate with one or more other computing devices. Such communication can occur via Input/Output (I/O) interfaces 522. Still yet, computer system/server 512 can communicate with one or more networks such as a local area network (LAN), a general wide area network (WAN), and/or a public network (e.g., the Internet) via network adapter 520. As depicted, network adapter 520 communicates with the other components of computer system/server 512 via bus 518. It should be understood that although not shown, other hardware and/or software components could be used in conjunction with computer system/server 512. Examples, include, but are not limited to: microcode, device drivers, redundant processing units, external disk drive arrays, RAID systems, tape drives, and data archival storage systems, etc.

Figure 6:
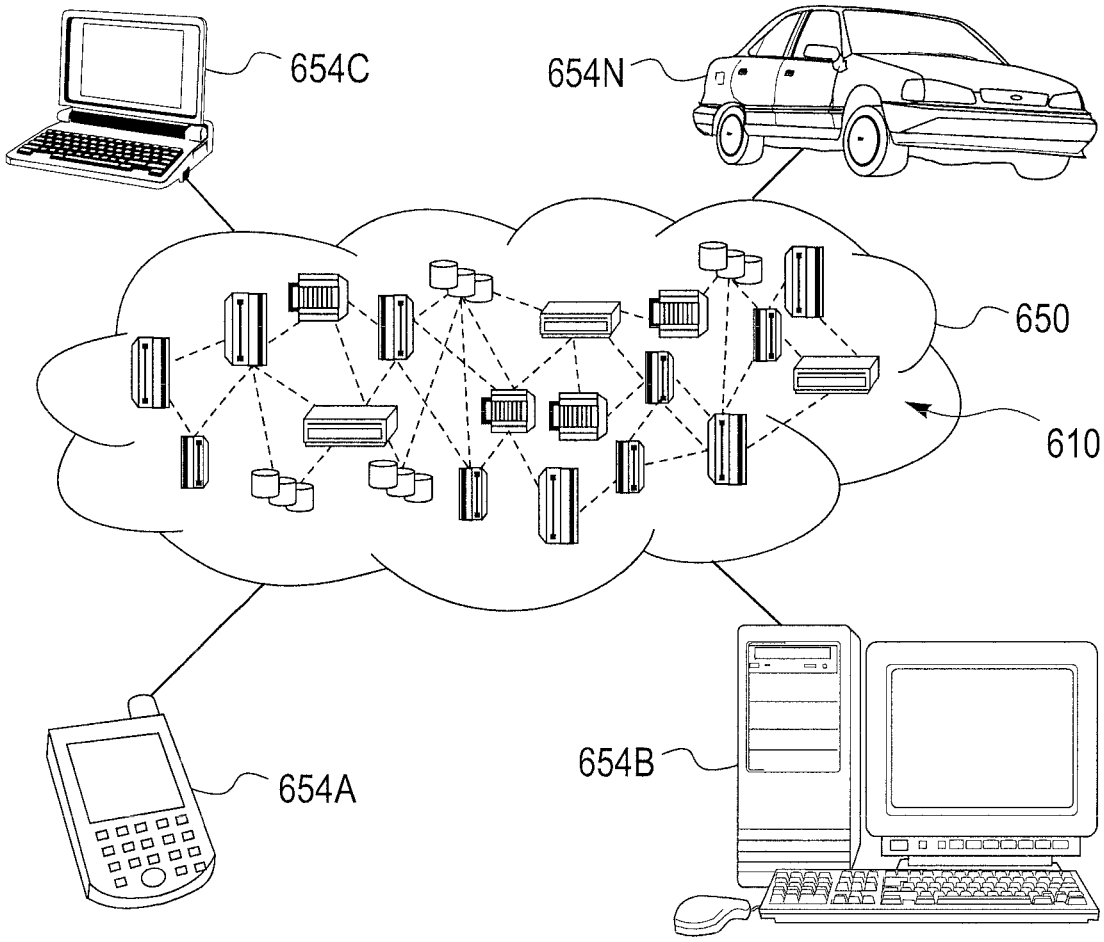
FIG. 6 shows an exemplary cloud computing environment 650, in accordance with an embodiment of the present principles.

Referring now to FIG. 6, illustrative cloud computing environment 650 is depicted. As shown, cloud computing environment 650 comprises one or more cloud computing nodes 610 with which local computing devices used by cloud consumers, such as, for example, personal digital assistant (PDA) or cellular telephone 654A, desktop computer 654B, laptop computer 654C, and/or automobile computer system 654N may communicate. Nodes 610 may communicate with one another. They may be grouped (not shown) physically or virtually, in one or more networks, such as Private, Community, Public, or Hybrid clouds as described hereinabove, or a combination thereof. This allows cloud computing environment 650 to offer infrastructure, platforms and/or software as services for which a cloud consumer does not need to maintain resources on a local computing device. It is understood that the types of computing devices 654A-N shown in FIG. 6 are intended to be illustrative only and that computing nodes 610 and cloud computing environment 650 can communicate with any type of computerized device over any type of network and/or network addressable connection (e.g., using a web browser).

Figure 7:
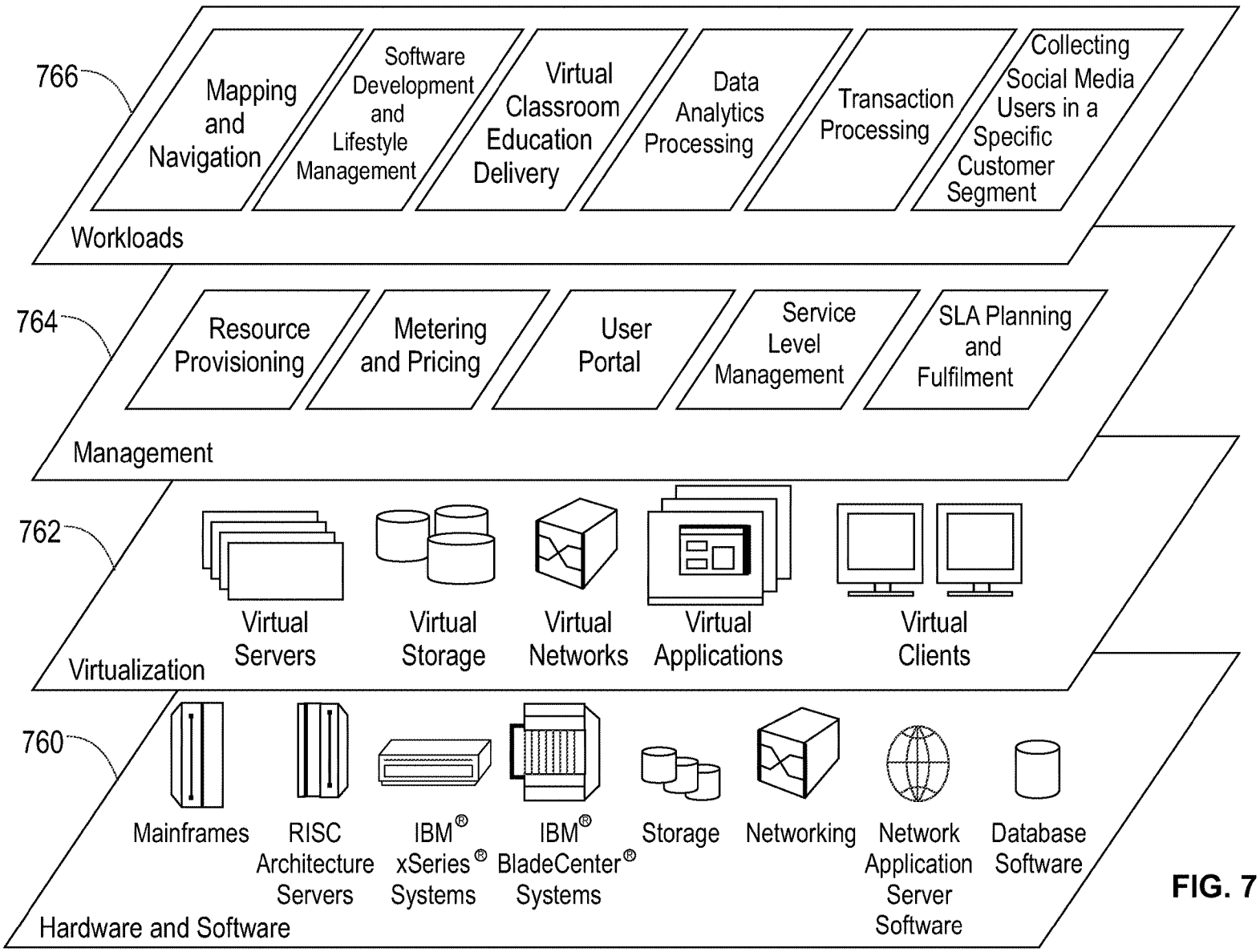
FIG. 7 shows exemplary abstraction model layers, in accordance with an embodiment of the present principles.

Referring now to FIG. 7, a set of functional abstraction layers provided by cloud computing environment 650 (FIG. 6) is shown. It should be understood in advance that the components, layers, and functions shown in FIG. 7 are intended to be illustrative only and embodiments of the invention are not limited thereto. As depicted, the following layers and corresponding functions are provided:

Hardware and software layer 760 includes hardware and software components. Examples of hardware components include mainframes, in one example IBM® zSeries® systems; RISC (Reduced Instruction Set Computer) architecture based servers, in one example IBM pSeries® systems; IBM xSeries® systems; IBM BladeCenter® systems; storage devices; networks and networking components. Examples of software components include network application server software, in one example IBM WebSphere® application server software; and database software, in one example IBM DB2® database software. (IBM, zSeries, pSeries, xSeries, BladeCenter, WebSphere, and DB2 are trademarks of International Business Machines Corporation registered in many jurisdictions worldwide).

Virtualization layer 762 provides an abstraction layer from which the following examples of virtual entities may be provided: virtual servers; virtual storage; virtual networks, including virtual private networks; virtual applications and operating systems; and virtual clients.

In one example, management layer 764 may provide the functions described below. Resource provisioning provides dynamic procurement of computing resources and other resources that are utilized to perform tasks within the cloud computing environment. Metering and Pricing provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal provides access to the cloud computing environment for consumers and system administrators. Service level management provides cloud computing resource allocation and management such that required service levels are met. Service Level Agreement (SLA) planning and fulfillment provide pre-arrangement for, and procurement of, cloud computing resources for which a future requirement is anticipated in accordance with an SLA.

Workloads layer 766 provides examples of functionality for which the cloud computing environment may be utilized. Examples of workloads and functions which may be provided from this layer include: mapping and navigation; software development and lifecycle management; virtual classroom education delivery; data analytics processing; transaction processing; and collecting social media users in a specific customer segment.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java, Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Having described preferred embodiments of a system and method (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A method for collecting social media users who have a specific profile, comprising:

retrieving over one or more networks, by a hardware network interface, a set of lists connected by at least one criterion to a particular list, the particular list included in a set of reliable lists whose users have already been reliably deemed to have a specific profile;

calculating, by a processor-based confidence value calculator, a first confidence value, based on a name of the particular list and names of each of the retrieved set of lists, and a second confidence value, based on a membership of the particular list and a membership of each of the retrieved set of lists, for each list in the retrieved set of lists by comparing each list in the retrieved set of lists to the particular list;

updating the set of reliable lists by adding all of the lists in the retrieved set of lists that have the first confidence value above a first threshold value and the second confidence value above a second threshold value;

outputting, by at least one of a display device and the hardware network interface, a listing of users belonging to the set of reliable lists as the social media users who have the specific profile; and sending a targeted advertisement to at least some of the users, having the specific profile, belonging to the set of reliable lists.

2. The method of claim 1, further comprising sorting the listing of users belonging to the set of reliable lists based on a margin over which at least one of the confidence values exceeds a corresponding one of the threshold values.

3. The method of claim 1, further comprising forwarding, by the hardware network interface, the listing of users belonging to the set of reliable lists to one or more remote devices, at least one of the one or more remote devices comprising a server.

4. The method of claim 3, wherein the server is comprised in a cloud environment.

5. The method of claim 1, wherein the at least one criterion comprises at least one of a same group label, a similar group label, a same group composition, and a similar group composition.

6. The method of claim 1, wherein the first confidence value is calculated based on a function that performs integration with respect to another function, the other function based on a logarithmic function and including a decay element.

7. The method of claim 1, wherein the second confidence value is calculated based on a dice coefficient.

8. The method of claim 7, wherein, for a given one of the lists in the retrieved set of lists, the dice coefficient is calculated between the particular list and the given one of the lists in the retrieved set of lists.

9. The method of claim 8, wherein the dice coefficient comprises a function that maps a given one of the lists in the retrieved set of lists to a set of users who belong to the given one of the lists.

10. The method of claim 1, wherein the second confidence value is calculated based on a function that maps a given one of the lists in the retrieved set of lists to a set of users who belong to the given one of the lists.

11. A computer program product for collecting social media users who have a specific profile, the computer program product comprising a non-transitory computer readable storage medium having program instructions embodied therewith, the program instructions executable by a computer to cause the computer to perform a method comprising:

retrieving over one or more networks, by a hardware network interface, a set of lists connected by at least one criterion to a particular list, the particular list included in a set of reliable lists whose users have already been reliably deemed to have a specific profile;

calculating, by a processor-based confidence value calculator, a first confidence value, based on a name of the particular list and names of each of the retrieved set of lists, and a second confidence value, based on a membership of the particular list and a membership of each of the retrieved set of lists, for each list in the retrieved set of lists by comparing each list in the retrieved set of lists to the particular list;

updating the set of reliable lists by adding all of the lists in the retrieved set of lists that have the first confidence value above a first threshold value and the second confidence value above a second threshold value;

outputting, by at least one of a display device and the hardware network interface, a listing of users belonging to the set of reliable lists as the social media users who have the specific profile; and sending a targeted advertisement to at least some of the users, having the specific profile, belonging to the set of reliable lists.

12. The computer program product of claim 11, further comprising forwarding, by the hardware network interface, the listing of users belonging to the set of reliable lists to one or more remote devices, at least one of the one or more remote devices comprising a server.

13. The computer program product of claim 12, wherein the server is comprised in a cloud environment.

14. The computer program product of claim 11, wherein the at least one criterion comprises at least one of a same group label, a similar group label, a same group composition, and a similar group composition.

15. The computer program product of claim 11, wherein the first confidence value is calculated based on a function that performs integration with respect to another function, the other function based on a logarithmic function and including a decay element.

16. The computer program product of claim 11, wherein the second confidence value is calculated based on a dice coefficient.

17. The computer program product of claim 16, wherein, for a given one of the lists in the retrieved set of lists, the dice coefficient is calculated between the particular list and the given one of the lists in the retrieved set of lists.

18. The computer program product of claim 17, wherein the dice coefficient comprises a function that maps a given one of the lists in the retrieved set of lists to a set of users who belong to the given one of the lists.

19. A system for collecting social media users who have a specific profile, comprising:

a hardware network interface for retrieving over one or more networks a set of lists connected by at least one criterion to a particular list, the particular list included in a set of reliable lists whose users have already been reliably deemed to have a specific profile;

a processor-based confidence value calculator for calculating a first confidence value, based on a name of the particular list and names of each of the retrieved set of lists, and a second confidence value, based on a membership of the particular list and a membership of each of the retrieved set of lists, for each list in the retrieved set of lists by comparing each list in the retrieved set of lists to the particular list; and a list manager for updating the set of reliable lists by adding all of the lists in the retrieved set of lists that have the first confidence value above a first threshold value and the second confidence value above a second threshold value, wherein at least one of a display device and the hardware network interface outputs a listing of users belonging to the set of reliable lists as the social media users who have the specific profile and sends a targeted advertisement to at least some of the users, having the specific profile, belonging to the set of reliable lists.

* * * * *